United States Patent [19]

Arabian

[11] Patent Number: 4,477,000

[45] Date of Patent: Oct. 16, 1984

[54] APPARATUS FOR FORMING PORTIONS OF SOAP FOAM

[75] Inventor: Sandro Arabian, Vaduz, Liechtenstein

[73] Assignee: Europtool Trust, Vaduz, Liechtenstein

[21] Appl. No.: 344,541

[22] Filed: Feb. 1, 1982

Related U.S. Application Data

[63] Continuation-in-part of Ser. No. 142,003, Apr. 21, 1980, Pat. No. 4,349,131.

[30] Foreign Application Priority Data

May 10, 1979 [CH] Switzerland ..... 4367/79
Nov. 18, 1981 [CH] Switzerland ..... 7399/81

[51] Int. Cl.[3] ..... B67D 5/42; B67D 5/54

[52] U.S. Cl. ..... 222/135; 222/185; 222/189; 222/190; 222/255; 222/276; 222/383; 239/343; 239/370; 417/199 R

[58] Field of Search ..... 222/135, 179, 181, 185, 222/190, 372, 383, 399, 336, 376, 189, 252, 255, 265, 275–277, 380, 5; 239/337, 338, 343, 370, 350, 413, 432; 417/199

[56] References Cited

U.S. PATENT DOCUMENTS 2,529,365 11/1950 Barksdale ..... 222/185
2,715,045 8/1955 Thompson ..... 239/343
2,871,058 1/1959 Puglia ..... 222/190 X
3,709,433 1/1973 Obergefell et al. ..... 239/343 X
3,712,512 1/1973 Snider, Jr. et al. ..... 222/190 X
4,360,130 11/1982 Nishimura et al. ..... 222/181 X

FOREIGN PATENT DOCUMENTS 0023975 2/1981 European Pat. Off. .
201577 5/1924 United Kingdom .

*Primary Examiner*—Joseph J. Rolla
*Assistant Examiner*—Kevin P. Shaver
*Attorney, Agent, or Firm*—Werner W. Kleeman

[57] ABSTRACT

An apparatus for forming and dispensing portions of soap foam or lather is provided with a double-acting compressed air membrane pump for generating compressed air and with a soap solution dosing pump. Both pumps are operated by means of a single lever which need only be pressed in a single direction, the return motion to the initial position being effected by a return spring. The forward actuation of the lever causes soap foam or lather to be formed in a mixing chamber. The return motion of the lever dispenses a dose of soap foam or lather through a dispensing aperture. In order to obtain a double-acting pump action of the membrane of the membrane pump, inlet valves and and outlet valves are employed. One of the outlet valves assists in the generation of the soap foam in the mixing chamber. The other outlet valve then assists in ejecting a portion of the soap foam through the dispensing aperture during the return motion of the lever.

5 Claims, 2 Drawing Figures

APPARATUS FOR FORMING PORTIONS OF SOAP FOAM

CROSS REFERENCE TO RELATED APPLICATION

This application is a continuation-in-part application of my commonly assigned, copending United States application Ser. No. 06/142,003, filed Apr. 21, 1980, and entitled "Apparatus for Dosing and Forming Soap Foam", now U.S. Pat. No. 4,349,131, granted Sept. 14, 1982.

BACKGROUND OF THE INVENTION

The present invention relates to a new and improved construction of an apparatus for forming portions of lather or soap foam.

Generally speaking, the lather forming and dispensing apparatus of the present development is of the type composed of a supply container for an aqueous soap solution. Furthermore, such apparatus contains a soap solution-dosing pump and a compressed air-membrane pump, each of which pumps can be actuated by a single lever or actuator. The compressed air-membrane pump is provided with a membrane or diaphragm piston and there is also provided a return or restoring spring as well as a mixing chamber for the formation of the lather or soap foam.

As is well known soap dispensers of the most different designs are employed in public and private washrooms, toilets and the like. Among these prior art soap dispensers there are known lather producing soap dispensers employing a propellant gas composed of dichlorodifluoromethane (more commonly known under the Trademark "FREON 12")and the widespread use thereof has been restricted because of enviromental reasons.

Furthermore, from European Patent Application No. 0019582, published Nov. 26, 1980, an the aforementioned U.S. Pat. No. 4,349,131 there is known in this technology an apparatus for dosing and forming lather or soap foam and which apparatus is of the general type discussed above. More specifically, such prior art dispenser equipment comprises a single lever for simultaneously driving a piston of a soap solution-dosing pump and a membrane pump for generating compressed air. This compressed air is forced into the soap solution available in a dosed quantity within a mixing chamber or compartment, by means of a perforated wall of a line or conduit. There is formed a coarse-bubble soap foam which is subsequently expressed through a porous body, then homogenized and compacted.

In practice this solution has been found to be extremely economical in terms of the consumption of soap. On the other hand, it has been found that the soap foam, especially when the dispensing apparatus is not used for a longer period of time, tends to dry and cake at the region of the outlet opening of the dispensing apparatus. This, in turn, has a detrimental effect upon the functional reliability of the dispensing apparatus.

SUMMARY OF THE INVENTION

Therfore, with the foregoing in mind it is a primary object of the present invention to provide a new and improved construction of dispensing apparatus for forming portions of soap foam or lather in a manner not afflicted with the aforementioned drawbacks and limitations of the prior art dispensing equipment.

Another and more specific object of the present invention is directed to a new and improved construction of apparatus for forming portions of lather or soap foam, wherein even after the dispensing apparatus is not used for a longer period of time it is nonetheless still immediately ready to reliably operate.

Still a further significant object of the present invention aims at providing a new and improved construction of dispensing apparatus for lather or soap foam, which apparatus is relatively simple in construction and design, extremely economical to manufacture, highly reliable in operation, not readily subject to breakdown or malfunction, and requires a minimum of maintenance and servicing.

Now in order to implement these and still further objects of the invention, which will become more readily apparent as the description proceeds, the inventive apparatus for the dispensing of lather or soap foam in portions, is manifested by the features that the compressed air-membrane pump is structured as a double-acting membrane pump.

According to a further aspect of the invention, it is contemplated that the effective or operative direction of the compressed air-membrane pump at the side of its piston rod serves for the compression and introduction of the compressed air into the mixing chamber or compartment, and the other effective direction of such membrane pump serves for the ejection or blowing-out of the lather or soap foam from the outlet opening of the dispensing apparatus. With this equipment design there is realised a pulse-like ejection of the portion of lather or soap foam, and thus there is prevented any clogging and/or continued dripping of the soap foam following the actuation of the dispensing apparatus.

Additionally, the infeed and outfeed lines for the compressed air of the membrane pump are provided with a respective valve at the side of its piston rod, and a further valve is provided in an infeed line serving for the ejection of the soap foam.

It is also contemplated, according to a further feature of the invention, that the valves possess substantially cylindrical valve bodies which bear in their rest position, due to the force of gravity, upon a related valve seat defining a sealing surface. In this way there can be further increased the operational integrity of the dispensing apparatus and thus its state of preparedness for carrying out its lather or soap foam dispensing function.

Also, the dispensing apparatus can be designed such that the membrane piston comprises two parts or components which at their concave surfaces face away from the piston rod. Between such piston parts there is clamped or otherwise retained the membrane or diaphragm of the membrane piston. This design of the double-acting piston of the compressed air-membrane pump affords the advantage of a high air output notwithstanding low structural volume and also provides for increased operating comfort.

BRIEF DESCRIPTION OF THE DRAWING

The invention will be better understood and objects other than those set forth above, will become apparent when consideration is given to the following detailed description thereof. Such description makes reference to the annexed drawing wherein.

DETAILED DESCRIPTION OF THE PREFERRED EMBODIMENTS

Figure 1:
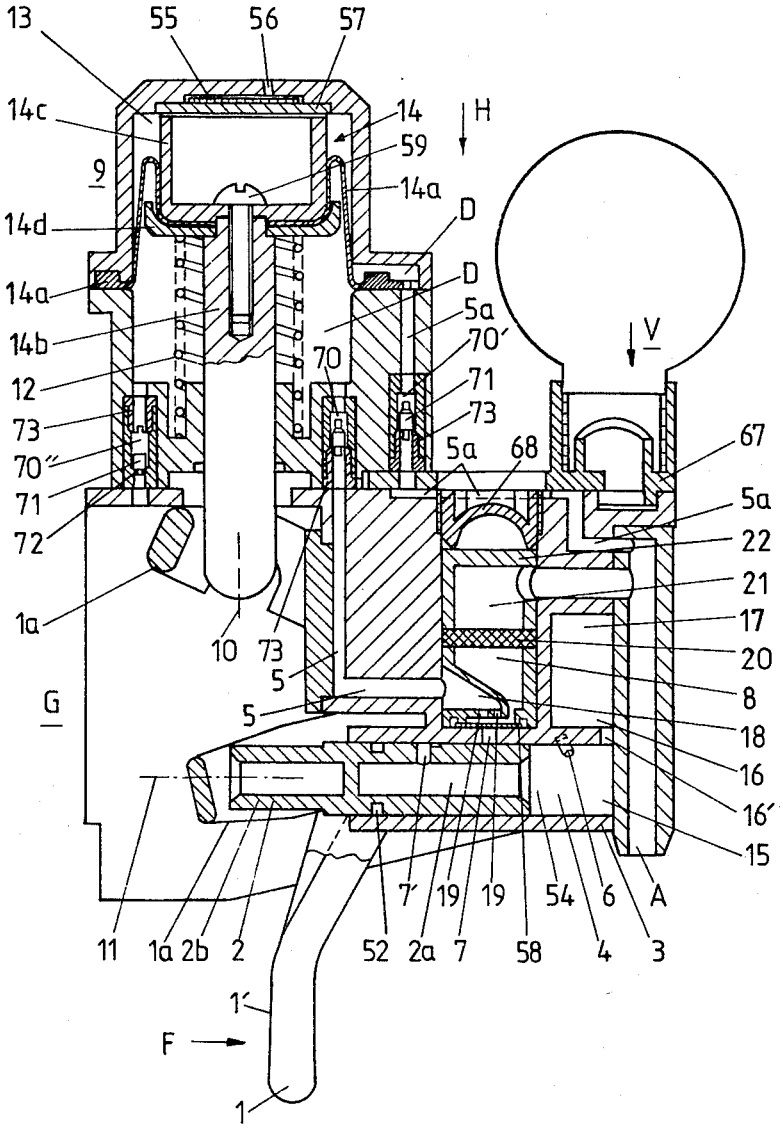
FIG. 1 shows in sectional view a preferred embodiment of the dispensing apparatus for lather or soap foam in its idle position.
Figure 2:
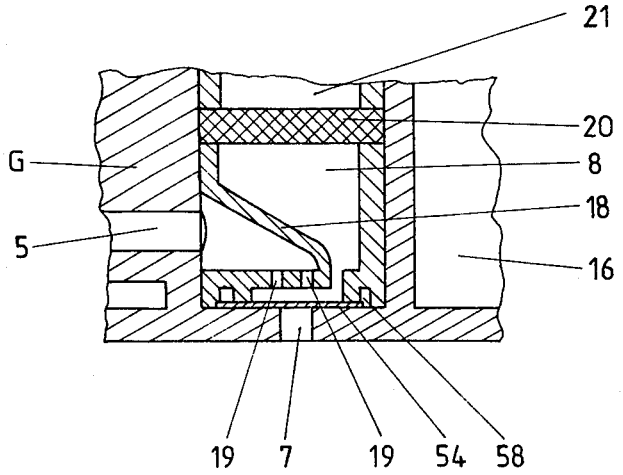
FIG. 2 shows in sectional view and on an enlarged scale in comparison to FIG. 1 a detail of an air inlet means.

Describing now the drawings, it is to be understood that the soap foam-dispensing apparatus of the present development constitutes an improvement upon the soap foam forming and dosing apparatus discussed at the introductory portion of this application and the dispensing apparatus constituting the subject matter of the aforementioned U.S. Pat. No. 4,349,131 granted Sept. 14, 1982 to which reference may be readily had. Turning attention now to the drawings in detail, reference character G designates the housing of the soap foam dispenser or dispensing apparatus. Protruding out of this housing G is an actuation lever or actuator 1 containing a hand grip 1'. Arranged over the housing G is a supply container V, which has been simply symbolised by the arrow, this supply container V being filled with an aqueous soap solution or the like. A mouthpiece 67 extends into the housing G and is connected by means of a lateral infeed line or infeed means 6 with a cylinder chamber or space 4 of a soap solution-dosing pump 3. Arranged within the soap solution-dosing pump 3 is a piston member or piston 2 containing a substantially cylindrical blind hole bore **2*a* and a piston outlet or exit opening 7'. This piston 2 is designed as a slide-like member and is sealed at one end by means of a O-ring 52 or equivalent sealing element. A not particularly illustrated bearing pin is inserted through the end portion 2*b* of the piston 2 which protrudes out of the cylinder chamber 4, this bearing pin being inserted in a frictional or force-locking fashion at both of its ends in a drive bracket 1*a* or equivalent structure. The cylinder chamber or compartment 4 is connected by means of a connection opening 7 with a mixing chamber or compartment 8. Protruding into the lower portion of the mixing chamber 8 is a nose-like end or nozzle of a line or conduit 18 through which there inflows compressed air D by means of a compressed air line or conduit 5 and can escape through the holes or perforations 19. The axis of the piston 2 is designated by the reference number 11. The upper arm 1*a* of the actuation lever 1 engages the piston rod 14*b* at the lower region of its central axis 10**.

The compressed or pressurised air D is generated within a membrane pump 9 by actuating the actuation lever 1 by applying thereto the indicated actuation force F. The cylinder 13 of this membrane pump 9 possesses a membrane or diaphragm **14*a* formed of rubber and which is guided by the concave pump parts or members 14*c* and 14*d*. These concave parts 14*c* and 14*d*, between which there can be clamped the pump membrane or diaphragm 14*a*, together with such diaphragm or membrane 14*a*, form a double-acting membrane piston 14. Actuating the actuation lever 1 moves this membrane piston 14 downward, thus generating a charge of pressurized air for forming the soap foam. The piston parts 14*c* and 14*d* along with the membrane 14*a* clamped therebetween can be retained at the piston rod 14*b* by a threaded bolt 59 or equivalent fastening structure. A return or restoring spring 12 encircles this piston rod 14*b* and forces the membrane piston 14** along with the therewith connected actuation elements into the upper illustrated position as shown in the drawing, thus generating a further charge of pressurized air for ejecting or expelling the soap foam from a dispensing aperture A.

The return or restoring spring 12, as shown in the drawing, is a cylindrical spiral compression spring urging the piston 14 toward the upper end of the cylinder 13 and at the same time effecting the return motion of the actuation lever 1. This actuation lever 1 is operatively connected at its upper region with the lower region of the piston rod **14*b* of the membrane pump 14 by means of a pivot pin not shown in the drawings, so that when the return or restoring spring 12 urges the membrane piston 14 upwards, it automatically pulls the actuation lever 1 into the rest or idle position shown in FIG. 1**.

The membrane piston 14 can experience a stroke H, in the downward direction, and when doing so draws air by means of an air inlet 56 and a flap valve 55 or equivalent structure into the pump cylinder 13.

The flap valve 55 is formed of, for instance, rubber and is fixed at one end by a holder 57 at the cover or top of the cylinder 13. The flap valve 55 is mounted in the holder 57 in the air inlet 56 to open during a downward or intake stroke H of the membrane pump 9 and to close upon the upward return or delivery stroke thereof.

A valve 70'' is shown in the lower region of the membrane pump 9 at its left-hand side. This valve 70'' is arranged below the pump membrane **14*a* and serves for the intake or inlet of the charge of air D in the chamber formed under this pump membrane 14*a* and surrounding the piston rod 14*b*. This valve 70'' therefore is arranged to close when moved away from the interior of the chamber surrounding the piston rod 14*b*. In this chamber surrounding the piston rod 14*b* there is a further valve 70. This valve 70 is arranged to close when moved towards the chamber surrounding the piston rod 14*b* and serves to transmit compressed air through an air conduit 5 for forming the soap foam in the mixing chamber 8. A further valve 70' is connected with the cylinder chamber on the other side of the pump membrane 14*a*. This valve 70' is incorporated in a compressed air conduit 5*a*** provided to eject or expel the soap foam out of the dispensing aperture A.

The apparatus G for forming a soap foam or lather is connected to a source of supply of aqueous soap solution, for instance with a supply reservoir or container schematically represented by the reference character V in FIG. 1. The downward arrow adjacent to the reference character V represents the direction of supply of soap solution.

In the illustrated rest position the cylinder chamber 4 is filled with soap solution with the exception of a small defined dead space 15. This dead space 15 essentially is constituted by a blind hole space 16 equipped with a connection bore 16'.

If the actuation lever 1 is now pressed with the actuating force F in the direction of the arrow, the piston rod **14*b* will be pulled downward by the upper region of the actuation lever 1. Simultaneously, the actuation lever 1 will move the piston 2 of the soap solution dosing pump 3 towards the right in the drawing. The charge of air beneath the membrane 14*a* will be compressed. The valve 70'' will be closed. The valve 70' will also be held closed but the valve 70 will be open, permitting the compressed air to be forced into the mixing chamber 8. These actions cause a predetermined amount of soap foam to be prepared. The soap solution is drawn from the source of supply or reservoir V by the action of gravity into the cylinder chamber 4 of the piston 2 of the soap solution dosing pump 3. The piston 2 moves towards the right into the cyliner chamber 4, which is connected to a blind space or equalisation chamber 16 by means of a connecting bore or aperture 16'. A cushion of air 17 forms in the upper region of this blind space or equalisation chamber 16 which is then compressed and therefore acts as an elastic or compensating element. When the piston 2 is in its final right-hand position, a piston port or passage opening 7' coincides with a connecting opening 7 to permit the transmission of the soap foam through the flap valve 54 into the mixing chamber 8. When the valve 70 is open, the pressurized air flows through the compressed air conduit 5 into the protruding foaming nozzle 18 which is provided at its lower surface with several orifices or apertures 19. These orifices 19 are oriented towards the direction of entry of the soap foam into the mixing chamber 8. The soap foam is forced through a porous body 20 into an expansion chamber 21**.

When the actuation lever 1 has been released, the compressed return or restoring spring 12 acts on the piston rod **14*b* to move the latter upwardly and with it the membrane 14*a*. During this action the valve 70" is opened so that air can be entrained into the chamber surrounding the piston rod 14*b* from the exterior. The valve 70 is, however, closed, thereby preventing the formation of further soap foam. Since the flap valve 55 in the upper region of the membrane pump 9 is also closed, the charge of air above the membrane is compressed and is forced through the compressed air conduit 5*a* and the valve 70'** into the dispensing aperture A as a result of which a portion of soap foam is expelled or discharged.

As can be seen in FIG. 1, there is a dead volume 15 at the end of the cylinder chamber 4 which is provided to assure that the connecting bore or passage 16' to the blind space or equalisation chamber 16 will not be closed. The double-armed actuation lever 1 comprises a handgrip 1' in its lower region and the actuating or upper arm **1*a* in its upper region which operatively engages the lower region of the piston rod 14*b*. The upper arm 1*a* is retained in engagement with the piston rod 14*b* by means of the return or restoring spring 12**.

The expansion chamber 21 is connected to the bore forming the dispensing aperture A by means of a foam guide member 22.

With the exemplary embodiment of dispensing apparatus for the production and dispensing of a soap foam or lather the respective lengthwise axis 10 and 11 of the pistons 2 and 14 are disposed essentially perpendicular to one another. the transmission of force from the actuation lever 1, which is here constructed as a double-arm lever, is accomplished by means of conventional bearing pins to the drive bracket **1*a* and the piston rod 14*b*, respectively. The flap valve 54 can be fabricated from synthetic rubber and can be centered at its marginal edge by means of a partially encircling holder ring 58** or equivalent structure.

The portion of the compressed air line or conduit **5*a*, shown in broken or phantom lines in the FIG. 1 of the drawing, can be disposed in a circular configuration about a threaded pin 68. This threaded pin 68 serves to positionally fix the foam deflection body 22 arranged centrally within the housing G, the porous body 20 and the mixing chamber or compartment 8**.

Suitable for use as the valves 70 70' and 70" are valve structures containing a substantially cylindrical-shaped valve body 71 formed of commercially available brass. These valves 70 further are provided with a valve bushing 73 and a valve seat 72 coacting as a sealing surface with the related valve body 71. The valve seat 72 may be formed of a likewise commercially available high-molecular formaldehyde-polymerisate, such as known under the mark "DELRIN".

The dispensing apparatus of the invention can be universally employed and, in particular, by virtue of its continuous high degree of operational reliability and its simply reproducible handling constitutes a considerable advancement in this technology and finds particular applicability as a hygienic soap foam dispenser for use in washrooms, toilet and the like.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for forming portions of foamed soap lather, comprising:

a supply container for an aqueous soap solution;

means defining a soap solution-dosing pump cooperating with said supply container;

means defining a compressed air-membrane pump cooperating with said dosing pump;

a single actuation lever for actuating said soap solution-dosing pump and compressed air-membrane pump;

said membrane pump containing a membrane piston;

return spring means cooperating with said membrane piston;

a mixing chamber for forming soap foam cooperating with said soap solution-dosing pump and said compressed air-membrane pump; and said compressed air-membrane pump being structured as a double-acting membrane pump.

2. The apparatus as defined in claim 1, wherein:

said membrane piston contains two piston parts;

each of said piston parts having a concave surface directed away from said piston rod; and a membrane of said membrane piston being clamped between said piston parts.

3. The apparatus as defined in claim 1, wherein:

said compressed air-membrane pump possesses two effective directions;

said membrane piston of said compressed air-membrane pump possessing a piston membrane and a piston rod which coacts with said return spring means;

one of said two effective directions of the compressed air membrane pump at a side of said piston membrane adjacent to said piston rod serving for the compression and introduction of compressed air into said mixing chamber; and an opposite other one of said two effective directions of said compressed air-membrane pump at a side of the piston membrane remote from the piston rod serving for the ejection of the soap foam out of aperture means defining an outlet opening for the soap foam.

4. The apparatus as defined in claim 3, wherein:

said compressed air-membrane pump being provided with means for the intake of ambient air and means for the discharge of compressed air;

said intake means comprising at least one valve arranged to communicate with said side of said membrane piston adjacent to said piston rod for the intake of ambient air;

said discharge means comprising a valve arranged to communicate with said side of said membrane piston adjacent to said piston rod for discharging compressed air to said mixing chamber for the formation of soap foam;

a compressed air conduit; and said discharge means further comprising a valve arranged to communicate with said side of said membrane piston remote from said piston rod by means of said compressed air conduit for discharging compressed air to expel soap foam from said aperture means defining said outlet opening.

5. The apparatus as defined in claim 4, wherein:

each of said valves possesses a substantially cylindrical valve body; and the sole actuating influence acting on said valve body being the force of gravity.

* * * * *

UNITED STATES PATENT AND TRADEMARK OFFICE

CERTIFICATE OF CORRECTION

PATENT NO. : 4,477,000

DATED : October 16, 1984

INVENTOR(S) : SANDRO ARABIAN

It is certified that error appears in the above—identified patent and that said Letters Patent is hereby corrected as shown below:

In the Abstract, line 13, after "and" please delete "and"

Signed and Sealed this

*Thirtieth* Day of *April 1985*

[SEAL]

*Attest:*

DONALD J. QUIGG

*Attesting Officer* *Acting Commissioner of Patents and Trademarks*